United States Patent [19]

Straubel et al.

[11] 4,378,775

[45] Apr. 5, 1983

[54] METHOD AND APPARATUS FOR FUEL INJECTION IN INTERNAL COMBUSTION ENGINES IN PARTICULAR DIESEL ENGINES

[75] Inventors: Max Straubel, Stuttgart; Hermann Eisele; Klaus-Dieter Zimmermann, both of Vaihingen; Wilhelm Vogel, Stuttgart, all of Fed. Rep. of Germany

[73] Assignee: Robert Bosch GmbH, Stuttgart, Fed. Rep. of Germany

[21] Appl. No.: 277,426

[22] Filed: Jun. 25, 1981

[30] Foreign Application Priority Data

Jul. 1, 1980 [DE] Fed. Rep. of Germany ..... 3024886
May 12, 1981 [DE] Fed. Rep. of Germany ..... 3118669

[51] Int. Cl.[3] ..... F02M 39/00
[52] U.S. Cl. ..... 123/458; 123/501; 123/446
[58] Field of Search ..... 123/446, 458, 497, 499, 123/478, 501

[56] References Cited

U.S. PATENT DOCUMENTS

| | | | |
|---|---|---|---|
| 3,709,639 | 1/1973 | Suda et al. | 123/499 |
| 3,724,436 | 3/1973 | Nagata et al. | 123/478 |
| 3,796,206 | 3/1974 | Links | 123/499 |
| 3,815,564 | 6/1974 | Suda et al. | 123/501 |
| 4,280,464 | 7/1981 | Kanai et al. | 123/478 |
| 4,306,528 | 12/1981 | Straubel et al. | 123/501 |

FOREIGN PATENT DOCUMENTS

| | | | |
|---|---|---|---|
| 404252 | 1/1934 | United Kingdom | 123/501 |
| 2031550A | 4/1980 | United Kingdom | 123/501 |

*Primary Examiner*—Ira S. Lazarus
*Assistant Examiner*—Magdalen Moy
*Attorney, Agent, or Firm*—Edwin E. Greigg

[57] ABSTRACT

In the method according to the invention, the inlet pressure and the inlet cross section of the fuel pre-stored in the pump work chamber is constant, and it is solely the opening duration of an inlet valve which is electrically regulated. In addition, a shift in the instant of supply onset controlled in accordance with operating characteristics is attained by means of a variation in the return-flow fuel quantity. A shift in the instant of supply onset, which is undesired when there is a change in the quantity of fuel to be injected, is prevented by means of a simultaneously-effected correction of the return-flow fuel quantity. A fuel injection apparatus suitable for performing the method has, as the inlet valve, a magnetic valve which determines the quantity of fuel pre-stored in the pump work chamber. The rotary position of the pump piston is variable in order to shift or correct the instant of supply onset by means of an adjacent device actuated by an electromechanical adjustment element. An electric control device emitting the metering pulse and a control pulse is connected with a set-point transducer and an adjustment-path transducer of the adjustment device. The apparatus can be equipped with either a pump/nozzle or a normal piston injection pump supplying the injection nozzle via a pressure line, or with a distributor injection pump.

29 Claims, 6 Drawing Figures

METHOD AND APPARATUS FOR FUEL INJECTION IN INTERNAL COMBUSTION ENGINES IN PARTICULAR DIESEL ENGINES

BACKGROUND OF THE INVENTION

The invention is based on a method for fuel injection in internal combustion engines, in particular diesel engines. The quantity of fuel to be injected is metered before the onset of the compression stroke, at a regulated, preferably constant fuel inflow pressure, by a controllable inflow cross section of an inflow valve. This inflow valve is inserted into an inflow line leading to the pump work chamber of a piston injection pump. The end of supply is fixed by means of the relief of the pump work chamber and thus by means of a controlled return-flow fuel quantity.

The invention is also based on a fuel injection apparatus for performing this method, which comprises a piston injection pump provided with an adjustment device for the correction of the end of the effective supply stroke. This adjustment device variably controls the relative position of a diversion opening and control face closing apparatus. A supply pump generates the necessary inflow pressure and is controlled by a regulating valve.

In a fuel injection pump known from German Examined Application DE-AS 1 143 674, the quantity of fuel to be injected is regulated, at a constant fuel inlet pressure, by means of the variable inlet cross section of an inlet valve which is embodied as a throttle element. The pump piston, which is provided with an oblique control edge in order to limit the effective supply stroke, is not, however, adjusted between idling and full load; instead, the oblique control edge fixes a termination of supply which always remains unchanged and a full-load quantity which is limited by the maximum possible fill level of the pump work chamber. The oblique control edge is capable solely of being adjusted in terms of its rotary position, in order to control an increased starting quantity. In this fuel injection pump, which is also known as an intake-throttle pump, the result is an injected onset which necessarily varies in accordance with the supply quantity; this injection onset can be corrected only via expensive injection adjusters, which are incorporated in the camshaft drive mechanism and transmit all the torque. It is the object of the invention to create a method for fuel injection, and apparatuses for performing this method, with which a change in supply onset which is either arbitrary or dependent on engine operating characteristics can be attained while retaining precise fuel-quantity metering avoiding the use of components which transmit drive torque.

OBJECT AND SUMMARY OF THE INVENTION

The method according to the invention is different from devices of the prior art, at least in that during the metering of the quantity of fuel pre-stored in the pump work room, the inlet pressure and the inlet cross section are kept constant. Also, the opening duration of the inlet valve is regulated electrically, and a shift in the instant of supply onset is controlled in accordance with engine characteristics by means of a change in the return-flow fuel quantity. When there is a change in the fuel quantity to be injected, the return-flow fuel quantity is simultaneously corrected in accordance with the metered fuel quantity in order to prevent an undesired shift in the instant of supply onset. Moreover, the method is attained by intentionally making use of the phenomenon, known in intake throttle pumps but undesired therein, of the shift in supply onset in accordance with fuel quantity. A shift of the instant of supply onset which is undesired in the case of a change in the fuel quantity to be injected is prevented by means of a correction which is simultaneously effected in the return-flow fuel quantity.

As a result of the characteristics further disclosed, advantageous improvements in the method described above are possible. In a method in which the return-flow fuel quantity is re-aspirated during a first portion of the intake stroke, a precise metering of the fuel quantity to be injected is attained solely by means of the inlet valve. In a method where the quantity of fuel to be injected and the fuel replacing the return flow quantity are metered by the inflow valve, the throttle losses which occur particularly at high rpm are avoided during the shutoff and re-aspiration of the return-flow fuel quantity. The fuel quantity metering is always effected with a fully opened inlet opening as controlled by the pump piston or a corresponding control member at the discharge location of the inlet line into the pump work chamber. Also, the metering is not influenced by pressure fluctuations, because in the resting period of the pump piston substantially more uniform pressure conditions are established than is the case when metering takes place during the course of the piston stroke movement. As a result of the cooperation of the pump piston movement and the opening duration of the inlet valve which is fixed by establishing a closing time subsequent to end of pre-storage as controlled by the pump piston, is determined solely by the instant of opening of the inlet valve.

In the methods described above the metering of the fuel quantity is effected by means of the inlet valve into the pump work chamber, which during the intake stroke of the pump piston is subjected to an underpressure which at least approximately equals the fuel vapor pressure. For this reason, with an inlet pressure which is selected to be relatively high (50 bar, for instance), it is possible for the vapor pressure of the fuel, which is to be applied as a counterpressure, to be considered as a constant pressure value on account of its very low underpressure values. This is especially true when, at high rpm, an underpressure which is below the vapor pressure is established. However, the inlet pressure or, preferably, the opening duration of the inlet valve can also be corrected in accordance with temperature. This correction is of advantage whenever the inlet pressure is not at such a high level (when it is at a level of 5 bar, for instance), so that the presure differences of vapor pressure of Diesel fuel (e.g., at 20° C.=0.0001 bar) compared with the vapor pressure value at 100° C.=0.05 bar of absolute pressure are already capable of influencing the fuel-quantity metering in a perceptible fashion.

The fuel injection apparatus for performing the methods described above has a magnetic inflow valve which, with its opening duration ($t_V$), determines the fuel quantity pre-stored in the pump work chamber. An adjustment device is also provided which is actuatable by an electromechanical adjustment element, which for the purpose of shifting and correcting the instant of supply onset is triggerable by means of a control pulse ($I_{FB}$, $I_K$). This adjustment device is dependent on at least one operating characteristic (Q, n, S), of an electric control device. Finally, the control device is connected with a set-point transducer and an adjustment-path transducer of the adjustment device and emits a metering pulse ($I_Z$) which determines the opening duration of the magnetic valve.

This apparatus enables the precise triggering of both the magnetic valve which determines the injection quantity and the adjusting device which influences the instant of supply onset. By the use of the adjustment-path transducer which is connected to the electric control device and with an adjusting device, the cross-influences of the supply quantity and the instant of supply onset can be compensated for by means of a precise mutual adaptation of the metering pulse, which determines the opening of duration of the magnetic valve, and the control pulse, which determines the instant of supply onset. In a fuel injection apparatus having a pump piston, provided with a first control edge which closes an inlet opening from the inlet line into the pump work chamber at least during the effective supply stroke and a second, oblique control edge embodied as an axial limitation of the control face. This second control edge opens the diversion opening located in the wall of the pump cylinder at the end of the effective supply stroke and can once again be closed after a first portion of the intake stroke to permit the re-aspiration of the return-flow quantity.

The termination of supply as is known from German Examined Application No. DE-AS 1 143 674 as noted above, the opening duration of the magnetic valve advantageously determines exclusively the quantity of fuel to be injection.

A fuel injection apparatus is also disclosed which provides a constant inlet cross section, ($A_Z$) which is formed by the inlet opening embodied as a throttle bore. The flow-through cross section is smaller than that of the magnetic valve and of the line section which is located between the magnetic valve and the inlet opening.

The pressure difference between the magnetic valve and the inlet opening is such that the volume of fuel in the line following the magnetic valve no longer has a negative influence on the fuel metering, as it would do if it were acting as a harmful clearance volume.

As a result of the disposition of a relief conduit which connects the inlet opening with a chamber that is under constant pressure, preferably inlet pressure ($P_Z$), it is possible to attain a pressure equalization in the inlet line over the entire effective supply stroke. At the same time, injection fuel leaking past the pump piston is prevented from having harmful retroactive effects on the magnetic valve.

By making the diversion opening closable by means of a valve, the throttling influences which would otherwise prevail in the pump work chamber during the re-aspiration of the return-flow fuel are eliminated. The effect of temperature on the fuel vapor pressure, which acts as a counter-pressure to the inlet pressure in the pump work chamber, is taken into consideration by means of an appropriate correction of the inlet pressure. The pressure regulating valve is provided with an adjustment element which corrects the restoring force of a pressure regulating spring in accordance with an operating temperature of the injection pump or of the fuel. Finally, as the result of other characteristics of the present invention, the undesired change in fuel quantity which occurs in the course of a rapid shift in the instant of supply onset is prevented or else corrected to a predetermined value, as discussed below.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
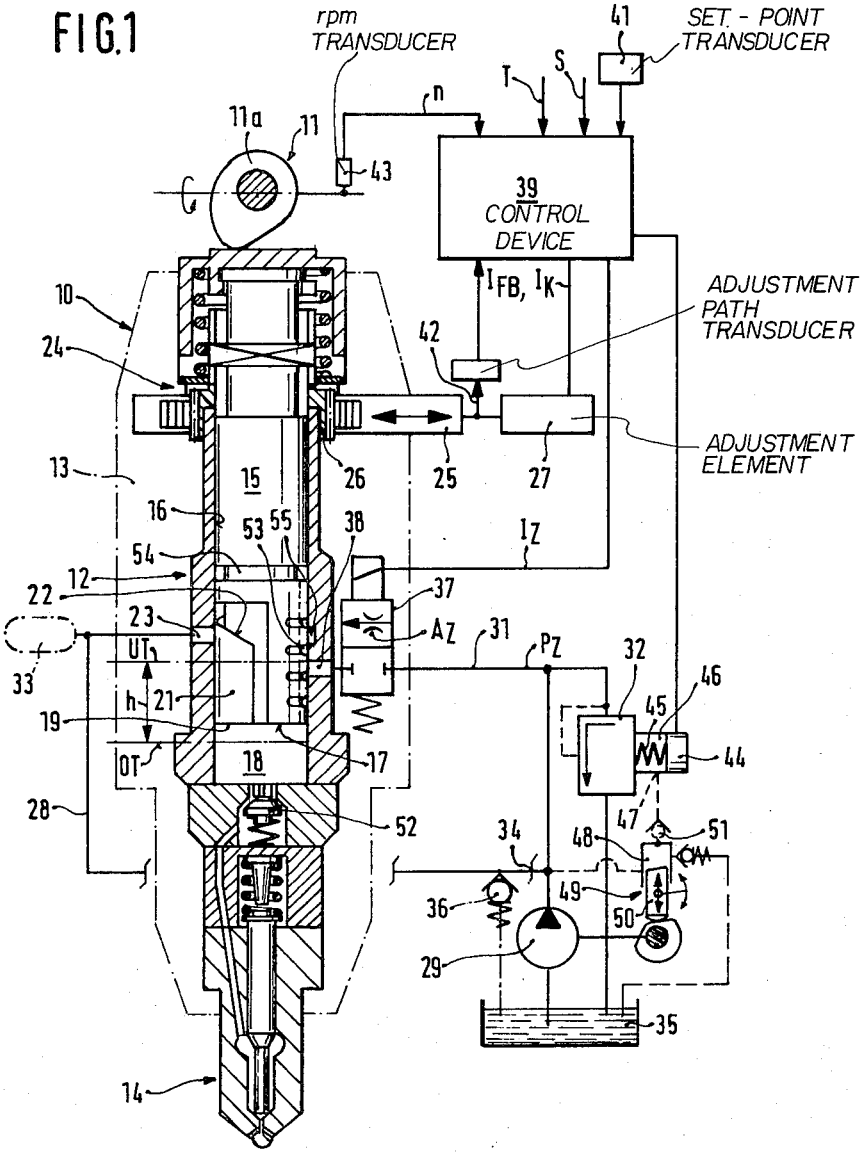
FIG. 1 is a simplified illustration of the first exemplary embodiment of a fuel injection apparatus embodied such as to perform the method in accordance with the invention, having an injection pump embodied as a pump/nozzle and shown in cross section.

In fuel injection apparatus shown in FIG. 1 as a first exemplary embodiment, a mechanically driven pump/nozzle 10 substantially comprises a piston injection pump 12, driven by a drive cam 11*a* of a drive mechanism 11 which is not shown in further detail, and an injection nozzle 14 which is combined with the piston injection pump 12 and disposed therewith in a common housing 13. The housing 13 is indicated only by dot-dash lines for the sake of simplification.

A pump piston 15 is guided within a pump cylinder 16 such that it is movable axially and rotationally. With its end face 17 remote from the drive mechanism 11, the pump piston 15 defines a pump work chamber 18 and has a first, horizontal control edge 19 embodied by the end face 17 and a second, oblique control edge 22 embodied as the axial limitation of a control face 21. By means of the oblique control edge 22, a diversion bore 23 located in the wall of the pump cylinder 16 can be opened at the end of the effective supply stroke and can be closed once again after a first portion of the intake stroke, which permits a re-aspiration of the return-flow fuel quantity, has been effected.

In order to correct or adjust the effective supply stroke of the pump piston 15, the piston injection pump 12 is equipped with an adjustment device 24; in a known fashion, this device comprises a longitudinally displaceable regulator rod 25 and a pinion sheath 26. Both elements 25 and 26 of the adjustment device 24 are provided with teeth, so that upon a longitudinal movement of the regulator rod 25 effected by an adjustment member 25, the pinion sheath 26 rotates the pump piston 15, and the relative position of the diversion opening 23 and the control face 21, which closes this opening during the effective supply stroke an is equipped with the oblique control edge 22, is changed. A return-flow line 28 is connected to the diversion opening 23 and discharges into an inlet line 31 receiving its supply from a supply pump 29. The fuel inlet pressure $p_Z$ which prevails in the inlet line 31 is regulated to a constant value, e.g., 50 bar, by a pressure regulating valve 32. This inlet pressure, which in comparison with the inlet pressure of known injection pumps is quite high, also prevails in the return-flow line 28, as a result of which the throttle losses occurring upon the re-aspiration of the return-flow fuel can be kept negligibly small. In addition, in order to reduce the throttling effect upon re-closure of the control opening 23, the diversion opening 23 may be embodied as a shaped hole with a limiting edge which is parallel to the oblique control edge 22. As needed, a plurality of diversion openings 23 may also be provided. The re-aspiration of the return-flow fuel quantity can also be improved by means of a reservoir 33 indicated by dot-dash lines, which should be disposed in the vicinity of the shutoff opening 23. If such a reservoir 33 is in place, then the connection between the return-flow line 28 and the inlet line 31 may also be interrupted, as indicated by a dividing line 34, and replaced by the direct return flow f fuel to a tank 35. The pressure in the return-flow line 28 can then be limited by a pressure maintenance valve 36 to a return-flow pressure which may as needed deviate from the inlet pressure $p_Z$. The pressures in the inlet and the return flow can thus be established independently of one another, in order to optimize the injection process to the most favorable values in a particular case.

The inlet line 31, which is controlled by an inlet valve 37, discharges with an inlet opening 38 into the pump cylinder 16. In the illustrated position of the pump piston 15, this inlet opening 38 is, however, covered by the control face 21, which with the exception of a stop groove encompasses the entire jacket face of the pump piston 15. The inlet opening 38 comes into communication with the pump work chamber 18 only once the pump piston 15 has executed its entire intake stroke and is in its inner or bottom dead center position. The respective inner or bottom dead center position (UT) and the outer or top dead center position (OT) of the pump piston 15 are indicated by dot-dash lines at a distance from the piston stroke h in FIG. 1 and are marked UT and OT, respectively.

The inlet valve 37 is embodied as a magnetic valve which with its opening duration $t_V$ measures a fuel quantity $Q_Z$ pre-stored in the pump work chamber 18. In the present example, the pre-stored fuel quantity equals the fuel quantity $Q_E$ which is to be injected. The magnetic valve 37 which is embodied as a 2/2-way valve is shown in the drawing in its closed position, and is arranged to receive a metering pulse $I_Z$, which determines its opening duration, from an electric control device 39, which includes an electronic regulating circuit and is connected with a set-point feeder 41, an adjustment-path transducer 42 of the adjustment device 24 and an rpm transducer 43 which emits an rpm signal n. The electric control device 39 additionally receives signals dependent on operating characteristics of the engine, such as a temperature signal T which is picked up at a suitable location and further signals marked by the letter S and indicating by way of example the charge-air pressure in the intake line of the engine, the exhaust gas temperature or the exhaust gas counterpressure.

The adjustment member 27 which actuates the regulating rod 25 is embodied as an electromechanical adjustment member, depending upon the required adjustment force exerted by an electromagnet, an electric servomotor or an electrohydraulic adjustment member. From the electric control device 39, this adjustment member 27 receives its control pulse $I_{FB}$, which is dependent upon at least one operating characteristic such as the load Q or the rpm n, or a correction pulse $I_K$ described in more detail below. The change in the rotary position of the oblique control edge 22 which is attainable with the adjustment device 24, and thus the change in the termination of supply, does not, however, determine the fuel injection quantity $Q_E$; instead, it serves in accordance with the invention to change the instant of supply onset. The associated new and inventive injection process will be explained further below, with the aid of the diagram given in FIG. 4 and a funtion description for the fuel injection apparatus shown in FIG. 1.

The fuel metering controlled by the magnetic valve 37 is effected at a constant fuel inlet pressure $p_Z$ across a constant inlet cross section $A_Z$, with a variable opening duration of the magnetic valve 37 determined by the metering pulse $I_Z$. The constant inlet cross section $A_Z$ may be provided by either the inlet opening 38 or the flow-through cross section of the magnetic valve. The latter is indicated in the switch symbol of the magnetic valve 37 by means of a through conduit provided with a flow throttle. The fuel inlet pressure $p_Z$ acts counter to a vapor pressure of the fuel which prevails in the pump work chamber 18 at the end of the intake stroke. At a very high inlet pressure of 50 bar, by way of example, this fuel vapor pressure with its extremely low absolute pressure values of 0.001 bar at 20° C. and 0.05 bar at 100° C. does not need to be measured precisely. Instead, in setting the metering pulse $I_Z$, this vapor pressure is presumed to be an absolute vacuum at zero bar. If it is desired nevertheless to take into consideration the operating temperature of the injection pump, then this is done when determining the metering pulse $I_Z$ by means of the temperature signal T in the electric control device 39; alternatively, the inlet pressure $p_Z$ can be corrected instead, by means of varying the initial stress of a pressure regulating spring 45 of the pressure regulating valve 32 via an adjustment member 44 triggered by the electric control device 39.

A new opportunity, which is inventive per se, of adapting the inlet pressure $p_Z$ is provided in that a chamber 46 of the pressure regulating valve 32 which contains the pressure regulating spring 45 communicates via an intake line 47 with a work chamber 48 of an auxiliary pump 49, which is driven parallel to the injection pump 12 or simultaneously with the supply pump 29 and is supplied with fuel by the supply pump 29. The intake line 47 contains a check valve 51 which opens in the direction toward the work chamber 48 and it can be set to provide a partial filling of the work chamber 48 in order to generate an underpressure equal to the fuel vapor pressure occurring upon each intake stroke of the injection pump 12. This setting is accomplished by the actuation of the pump piston 50 which is provided with an oblique control face. The use of such an auxiliary pump, here embodied by the piston pump 49, is relatively expensive and is intended for attaining extremely precise metering; it is shown in the drawing solely as a possible alternative, as suggested by the dashed lines indicating the various fuel lines.

The pump work chamber 18, which is closed by a pressure valve 52 in the direction of the injection nozzle 14, is kept as small as possible to avoid having dead-volume space. In order furthermore to assure that pressure conditions in the inlet opening 38 will always be the same during each metering process, the portion of the jacket face of the pump piston 15 which closes the inlet opening 38 of from the pump work chamber 18 during the effective supply stroke is provided with a relief conduit arrangement 53. This conduit arrangement 53, which may be embodied in the form of that known from German Offenlegungsschruft 27 20 279 and comprising longitudinal and transverse grooves, communicates in addition with an annular relief groove 54, so that is also serves the purpose of guiding the return flow of leakage oil. By means of this conduit arrangement 53, the inlet opening 38, in every reciprocal and rotary position of the pump piston 18 in which the inlet opening is separated from the pump work chamber, communicates with a chamber which is under constant pressure, preferably inlet pressure $p_Z$; in the present example, this chamber is embodied by a partial annular groove 55 in the inner wall of the pump cylinder 16. In a manner not shown in further detail, this groove 55 communicates with the portion of the inlet line 31 which is continuously under fuel inlet pressure $p_Z$; that is, the groove 55 communicates with the portion of this line 31 located between the supply pump 29 and the magnetic valve 37.

Figure 2:
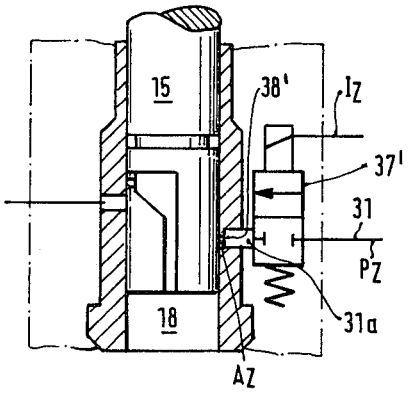
FIG. 2 is a detail of the second exemplary embodiment, which is otherwise embodied like that of FIG. 1, seen in the vicinity of the inlet opening.

The second exemplary embodiment, which is shown only in part in FIG. 2, differs only slightly from the first exemplary embodiment shown in FIG. 1. Identical elements are therefore given identical reference numerals, while those which are different are given a prime.

The inlet opening which is blocked off from the pump work chamber 18 by the pump piston 15' during the effective supply stroke is indicated here by reference numeral 38', and it is embodied as a throttle bore providing the constant inlet cross section $A_Z$. The flow-through cross section of this throttle bore 38' must therefore be smaller than that of the magnetic valve 37', and also smaller than that of the line section 31*a* of the inlet line 31 located between the magnetic valve 37' and the inlet opening 38'. By means of the described disposition of the inlet opening 38' embodied as a throttle bore, it is possible to assure that the identical pressure status always prevails in the line section 31*a* both before and after the end of the metering effected by the magnetic valve 37'. This is the case especially when the end of the pre-storage of fuel is controlled by the pump piston 15' itself; that is, in order to fix the opening duration $t_V$ of the inlet valve 37', only its instant of opening $t_Ö$ is changed, and the instant of closing $t_S$ is fixed at an instant subsequent to the end of the pre-storage controlled by the pump piston 15'. This relationship will be described in greater detail below, in the course of the functional description pertaining to FIG. 4.

Figure 3:
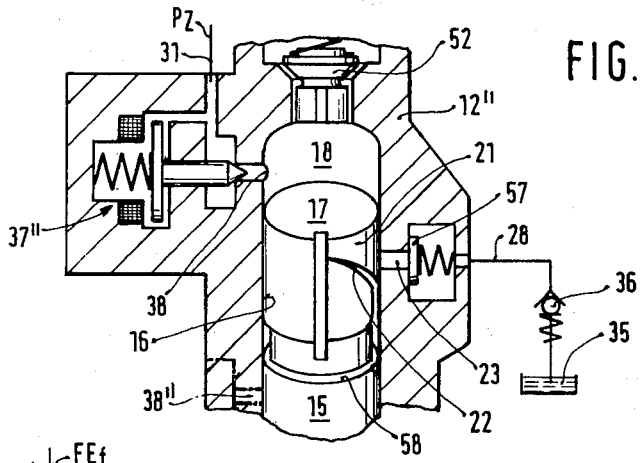
FIG. 3 is a cross section through the third exemplary embodiment.

The third exemplary embodiment of FIG. 3, again shown only in part, illustrates a piston injection pump 12" in the vicinity of the pump work chamber 18, with a magnetic valve 37" controlling the fuel metering from the inlet line 31 to the inlet opening 38 into the pump work chamber 18. As in the case of the examples described above, the pump piston 15" is provided with an oblique control edge 22, which is which is embodied as an axial limitation for the control face 21. By means of this control edge 22, the diversion bore 23 located in the wall of the pump cylinder 16 is opened at the end of the effective supply stroke, and thus the return-flow fuel quantity, which in the present invention influences the instant of supply onset, is measured. Deviating from the above-described examples, however, the diversion opening 23 in this example is closable by means of a valve 53 which prevents the re-aspiration of the return-flow fuel into the pump work chamber 18. This valve 53 is shown in FIG. 3 as a simple check valve; however, it is also possible for it to be replaced, as is conventional in distributor injection pumps, by a slide control means. The diverted return-flow fuel here flows back via the return-flow line 28 to the tank 35, either directly or via a pressure maintenance valve 37 providing the counter-pressure.

The pump element shown only in part in FIG. 3 may be part of a known single injection pump or part of a series injection pump; it is also possible for the piston injection pump 12", disposed directly after the pressure valve 52, to be combined with the associated injection nozzle to make a pump/nozzle unit.

In the case of the injection pump 12" described above, the magnetic valve 37" is embodied as a needle valve controlling the inlet opening 38, and it functions as a 2/2-way valve which is pressure-equalized with respect to the inlet pressure $p_Z$ which prevails in the inlet line 31. The inlet opening 38 is disposed here in such a way that it communicates continuously with the pump work chamber 18; however, should this be desired because of the pressure conditions, it may also be placed so low that it is closed by the end face 17 of the pump piston 15" during the compression stroke of the pump piston 15". It may in fact be placed still lower, as indicated by dot-dash lines at 38", and controlled by a lower annular groove 58 of the pump piston 15", preferably only near bottom dead center of the pump piston 15", which is shown in the drawing in an intermediate position between bottom and top dead center.

Figure 4:
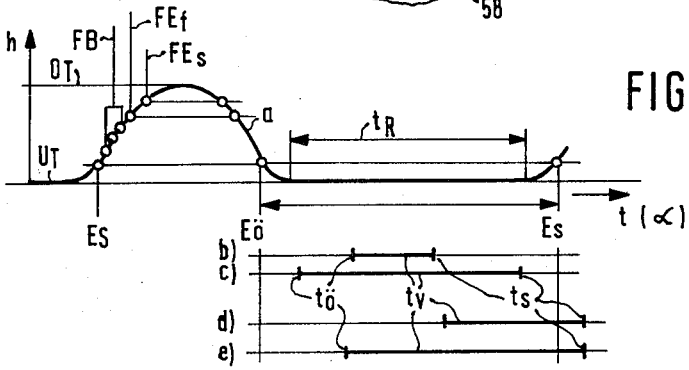
FIG. 4 is a function diagram for the piston stroke.

The diagram given in FIG. 4 shows a curve a plotted over the time t, in order to illustrate the piston stroke h, and the associated opening duration $t_V$ of the magnetic valves 37, 37' or 37" between the respective instant of opening $t_Ö$ and the instant of closing $t_S$ is shown in the form of horizontal bar diagrams b through e. In the supply edge of the piston stroke curve a which rises from UT toward OT, several points are plotted which characterize the supply onset FB and the end of supply FE; $FE_f$ indicates the end of supply for directing an early supply onset, and $FE_s$ indicates end of supply for directing a late supply onset. The disposition of the supply onset point FB is dependent on the pre-stored quantity of injection fuel which is to be supplied and on the end of supply which is regulated for correcting the supply onset, as will be further explained below in the functional description. The bar diagrams b through e of the opening duration $t_V$ of the inlet valve correspond to the associated metering pulse $I_V$ of these valves. The symbol $t_R$ designates a rest period of the pump piston 15 which occurs at bottom dead center; at $E_s$, the pump piston 15 closes the inlet opening 38 and at $E_Ö$, the pump piston 15 closes the inlet opening 38 once again.

Figure 5:
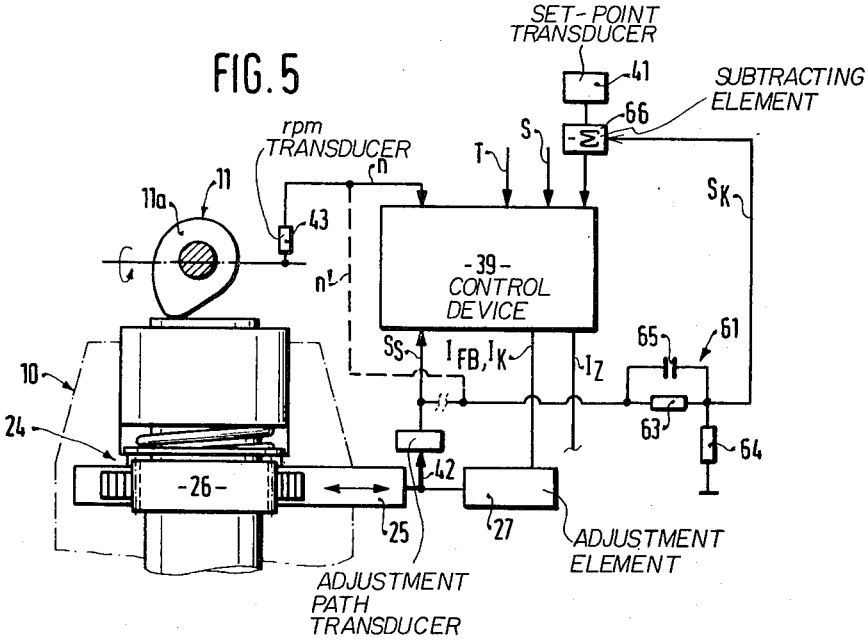
FIGS. 5 and 6 each illustrate a detail of the first exemplary embodiment of FIG. 1, with two variants of a differentiation member for correcting the metering pulse.
Figure 6:
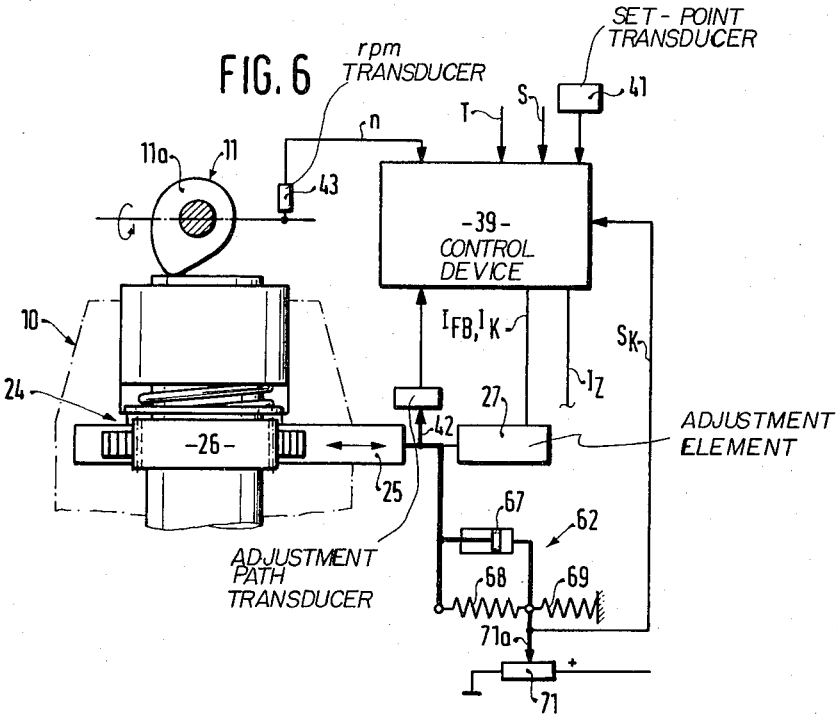

FIGS. 5 and 6 are details of two variants of the first exemplary embodiment shown in FIG. 1, each having a differentiation element 61 and 62, with the aid of which an undesired change in fuel quantity when there is a rapid shift in the instant of supply onset can be prevented or can be corrected to a predetermined value.

The electric differentiation element 61 comprises two resistors 63 and 64 and a capacitor 65. The differentiation element 61 is inserted into a connection betweemn the adjustment-path signal $S_S$ of the adjustment-angle transducer 42 and the set-point value feeder 41, and it generates a correction signal $S_K$, which is fed as a corrective value to the set-point value feeder 41 via a subtracting element 66.

If the displacement of the regulating rod 25 is effected approximately linearly with the rpm n, then the correction signal $S_K$ generated by the differentiation element 61 can also be derived from the rpm n, as is indicated by n' and by broken lines in FIG. 5. The connection with the adjustment-path signal $S_S$ is then interrupted, as suggested by the dashed S-shaped lines.

The differentiation element 62 shown in FIG. 6 is an electromechanical differentiation element, in which the movement of the regulating rod 25 is transmitted via a mechanical damping member comprising a hydraulic damper 67 and two springs 68 and 69 onto the sliding contact 71*a* of a potentiometer 71. The correction signal $S_K$ is fed by the potentiometer 71 into the control device 39 and there corrects the metering pulse $I_Z$ for the magnetic valve 37 in a known manner. This correction is necessary when there is a rapid shift in the instant of supply onset in order to prevent an undesired change in fuel quantity which then occurs or else to reduce it to a predetermined value.

The mode of operation of the first exemplary embodiment will now be described with the aid of FIGS. 1 and 4:

If the pump piston 15, in its position shown in FIG. 1, now continues its supply stroke, then the end of supply FE is determined by the oblique control edge 22, if this element opens the diversion opening 23 and relieves the pump work chamber 18 toward the return-flow line 28. The end of supply takes place relatively late when the pump piston 15 is in the illustrated rotary position; that is, the end of supply occurs at $FE_s$, because only a small return-flow quantity $Q_R$ is diverted. The return flow is terminated at bottom dead center, and the return flow quantity $Q_R$ is re-aspirated into the pump work chamber 18 at the beginning of the intake stroke via the diversion opening 23, until the oblique control edge 22 closes off the diversion opening 23.

As the intake stroke of the pump piston 15 continues as far as the bottom dead center position UT, the pump work chamber 18 is placed under underpressure, which approximately equals the vapor pressure of the fuel. Within the rest period which is indicated by $t_R$ in the diagram of FIG. 4, the fuel quantity to be injected is metered at $t_Ö$ (that is, when the inlet opening 38 is fully opened) via the magnetic valve 37 by means of the pulse duration which is controlled by the metering pulse $I_Z$ and begins at $t_Ö$; this metering is effected in accordance with curve b for a small injection quantity $Q_E$ and in accordance with curve c for a large injection quantity $Q_E$. After $t_R$, then, the compression stroke of the pump piston 15 begins, as follows: first, the hollow chamber in the pump work chamber 18 which is under vapor pressure and whose volume is dependent on the pre-stored fuel injection quantity and on the re-aspirated return-flow quantity is compressed, until the supply onset FB begins and the fuel, placed under injection pressure, opens the pressure valve 52, and the fuel reaches the injection nozzle 14, and from there enters the working cylinders of the engine.

The injection is terminated when, shortly subsequent to the position of the pump piston 15 shown in FIG. 1, the oblique control edge 22 connects the diversion opening 23 with the pump work chamber 18 as already described. The control of the supply end FE by the change in rotary position of the oblique control edge 22, or by the adjustment movement of the regulating rod 25 effected by the electromechanical adjustment member 17, does not, as in known pumps, serve the purpose of regulating the supply quantity; instead, it determines the instant of supply onset FB by means of the return-flow fuel quantity $Q_R$ which is diverted and then re-aspirated. If the opening duration $t_V$ of the magnetic valve 37, controlled by the metering pulse $I_Z$ of the control device 39, is then changed in order to bring about a different fuel injection quantity, the regulating rod 25 is caused to follow up this action with an appropriately adapted adjusting speed by means of the correction pulse $I_K$ via the adjustment member 27, and the return-flow fuel quantity is corrected such that the instant of supply onset remains constant. If it is desired instead to vary the instant of supply onset while the fuel injection quantity remains the same, this being accomplished in accordance with the rpm n or the load, which is characterized by the injection quantity $Q_E$, then a different rotary position of the pump piston 15 is established by means of the adjustment device 24. In order to regulate this rotary position precisely, the adjustment device 24 which is provided with the electromechanical adjustment member 27 is provided with the adjustment-path transducer 42, which furnishes the electric control device 39 with an adjustment-path signal. This adjustment-path transducer 42 is only suggested in FIG. 1, and it is disposed at an arbitrary location of the adjustment device 24 and embodied by a travel transducer functioning capacitively, inductively, or in some other known manner.

In the case of rapidly-occurring changes in the instant of supply onset, however, the metering pulse duration $I_Z$ must be additionally varied during a short transitional period, in order to prevent an undesired change in fuel quantity or to correct this quantity to a predetermined value. This correction is effected purely electrically, as shown in FIG. 5, by means of the differentiation element 61 or electromechanically, as shown in FIG. 6, by means of the differentiation element 62. The correction signal $S_K$ of the two variant embodiments varies the set-point feeder 41 via the subtracting element 66, as shown in FIG. 5, or else it may also be fed directly into the control device 39 as indicated in FIG. 6 and thereby briefly vary the metering pulse $I_Z$. In the case of a change in instant of supply onset controlled in accordance with rpm, the correction signal $S_K$ emitted by the differentiation element 61 may also be derived directly from the rpm signal n of the rpm transducer 43, especially when the adjustment path of the regulating rod 25 is linearly dependent on the rpm (see signal n' in FIG. 5).

Since the pre-stored fuel quantity can also be controlled precisely in accordance with the opening duration of the magnetic valve 37, the inlet cross section $A_Z$ is determined, as already noted, by a constant flow-through cross section of the magnetic valve 37 and the inlet pressure $p_Z$ is regulated by the pressure regulating valve 32 to a constant value which is adapted as need be, by means of an appropriate correction, controlled for instance by an auxiliary piston pump 49, solely in accordance with the temperature-dependent change in the vapor pressure in the pump work chamber 18. If the opening and closing instants $t_Ö$ and $t_S$ of the magnetic valve 37 occur within the resting period $t_R$ of the pump piston 15, then pressure conditions are least influenced by fluctuations.

If, as has already been described in connection with FIG. 2, the constant inlet cross section $A_Z$ is embodied by the inlet opening 38'', then the pressure conditions prevailing in the inlet line section 31*a* (see FIG. 2) are influenced in a particularly favorable manner if the control of the opening duration $t_V$ of the magnetic valve 37' is effected in accordance with curves d and e in FIG. 4. Here, the injection quantity is determined by the shifting of the instant of opening $t_{\ddot{O}}$ of the magnetic valve 37' and by the closure of the inlet opening 38'' at $E_S$ by the pump piston 15'. The instant of closure of the magnetic valve 37' is then shifted by a preferably constant amount to a time subsequent to $E_S$; in other words, only the opening instant $t_{\ddot{O}}$ continues to determine the quantity.

If in accordance with FIG. 3 the diversion opening 23 is closable with a check valve 57 or a corresponding valve element, then the return-flow fuel quantity $Q_R$ determined by the rotary position of the oblique control edge 22 is not re-aspirated into the pump work chamber 18 at the onset of the intake stroke; instead, the magnetic valve 37'' is designed such that with its opening duration $t_V$ it prestores a quantity of fuel in the pump work chamber 18 which represents both the quantity of fuel to be injected and a quantity of fuel acting as a replacement for the return-flowing fuel quantity (which, by its volume, influences the onset of supply); this replacement quantity is therefore likewise called a "return-flow quantity". This additional check valve 57 may also be used in the pump/nozzles 10 in FIGS. 1 and 2, in which case the metering pulse $I_Z$ is then prolonged accordingly.

In order to perform the method according to the invention, not only can the described pump/nozzles 10 or the injection pump 12'' be used; the method can also be used in the case of injection pumps controlled by reciprocating slides or in distributor injection pumps. What is common to all the possible uses of the method is the inventive concept that during the metering of the fuel quantity pre-stored in the pump work chamber, which has been partially evacuated during the intake stroke, not only the inlet pressure but the inlet cross section as well are kept constant, and only the opening duration of the inlet valve is regulated electrically; further that a shift in the instant of supply onset controlled in accordance with operating characteristics is attained by means of a change in the return-flow fuel quantity; and, finally, that when there is a change in the quantity of fuel to be injected, an undesired shift in the instant of supply onset is prevented by means of a simutaneously-effected correction of the return-flow fuel quantity. When the return-flow fuel quantity is re-aspirated, the opening duration of the magnetic valve alone determines the fuel quantity to be injected. When the diversion opening is blocked by a valve which prevents a re-aspiration of the return-flow fuel quantity, both the quantity of fuel to be injected and a quantity of fuel which replaces the return-flowing fuel quantity are metered by means of the opening duration of the inlet valve.

The control device 39 with the set-point transducer 41 and the rpm-transducer 43, the adjustment element 27 with the adjustment-path transducer 42 and the inlet valve 37 are in themselves not the object of the present invention. It is preferable to use for the measuring of the fuel quantity $Q_Z$ the control device and as the inlet valve 37 a magnetic valve of the "L-Jetronic" produced by Robert Bosch GmbH, Stuttgart, and disclosed in U.S. Pat. No. 3,750,631 and British Pat. No. 1,174,479. The control device 39 also includes an arrangement for generating both a fuel quantity signal and a signal for shifting the instant of fuel supply onset (timing) as disclosed in U.S. Pat. No. 3,796,197. It is preferable to use also for this purpose a control device comprising a microprocessor as disclosed in U.S. Pat. No. 4,204,256. As the adjustment element 27 and the adjustment-path transducer 42 with the respective part of the control decive 39 there also may be used means as disclosed in U.S. Pat. No. 4,019,478.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. A method of injecting fuel by a fuel injection assembly into an internal combustion engine, in particular a Diesel engine, having a fuel supply with an instant of onset, an inlet line, an inlet valve, a piston injecting pump with a pump work chamber, a relief means, a fuel metering means, an electrical regulating means, and a fuel return means the steps including:

metering a quantity of fuel to be injected with the fuel metering means, before the engine compression stroke, injecting the metered quantity of fuel into the engine with the piston injection pump, regulating the flow of fuel in the inlet line with the inlet valve having an opening duration, which leads to the pump work chamber, pre-storing the metered quantity of fuel in the pump work chamber, fixing the end of fuel supply by relieving the pump work chamber with the relief means, wherein metering of the quantity of fuel prestored in the pump work chamber with the fuel metering means occurs while:

keeping the pressure of the fuel constant in the inlet line; and keeping the inlet cross-section of the inlet valve constant; and wherein regulating the supply of fuel to be injected into the internal combustion engine occurs by regulating the opening duration of the inlet valve with the electrical regulating means, correcting the quantity of fuel in the fuel return means in accordance with the metered fuel quantity during changing of the quantity of fuel prestored in the work chamber.

2. A method as defined in claim 1, the steps also including:

shifting the instant of fuel supply onset in accordance with engine characteristics by changing the quantity of fuel in the fuel return means, re-aspirating the quantity of fuel in the fuel return means;

wherein only the quantity of fuel to be injected is metered by means of the opening duration of the inlet valve.

3. A method as defined in claim 1, the steps also including:

preventing the re-aspiration of the quantity of fuel in the fuel return means; and replacing the quantity of fuel in the fuel return means with a second fuel quantity;

metering the quantity of fuel to be injected and the second fuel quantity by means of the opening duration of the inlet valve, and shifting the instant of fuel supply onset in accordance with engine characteristics by changing the second fuel quantity.

4. A method as defined in claim 1, wherein the inlet line is connected to the pump work chamber through an inlet opening, and wherein the assembly also includes a control member, the steps including:

opening the inlet opening;

controlling the instants of opening and closing of the inlet valve with the control member during the opening duration of the inlet opening.

5. A method as defined in claim 1, wherein the inlet line is connected to the pump work chamber through an inlet opening, and wherein the assembly also includes a pump piston, the steps including:

opening the inlet opening;

controlling the instant of opening and closing of the inlet valve with the pump piston during the opening duration of the inlet opening.

6. A method as defined in claim 5, the steps including:

keeping the pump piston in an inner dead center position;

controlling the inlet valve opening duration only after the end of an intake stroke while the pump piston is at inner dead center.

7. A method as defined in claim 1, the steps also including:

moving the pump piston to end pre-storage of fuel in the pump work chamber;

correcting the opening duration of the inlet valve by only varying the instant of opening of the inlet valve;

fixing the instant of closing of the inlet valve at time which is subsequent to the end of pre-storage of fuel in the pump work chamber.

8. A method as defined in claim 1, the assembly also including a temperature sensing means, the steps also including:

correcting the inlet pressure according to temperature with the temperature sensing means.

9. A method as defined in claim 1, the assembly also including a temperature sensing means, the steps also including:

correcting the opening duration of the inlet valve according to temperature with the temperature sensing means.

10. A method as defined in claim 1, the assembly also having a detecting means the steps also including:

detecting a rapid shift in the instant of supply onset;

correcting the opening duration of the inlet valve during a transitional period, such that when the instant of supply onset shifts to a later time the fuel quantity is reduced, and such that when the instant of supply onset is towards an earlier time, the fuel quantity is increased.

11. An apparatus for regulating fuel injection in an internal combustion engine having a fuel supply pump which provides an inlet pressure, in particular a Diesel engine, having a piston injection pump which includes:

a piston;

a pump work chamber;

an adjusting device connected to the piston injection pump to alter the end of a piston supply stroke;

a diversion opening in the wall of the piston injection pump;

a control face on the piston which controls the diversion opening;

an inlet line provided with an inlet valve;

a pressure regulating valve connected to regulate the inlet pressure;

wherein the inlet valve is a magnetic inlet valve and is connected to the pump work chamber to regulate a fuel quantity which is prestored in the pump work chamber; the piston injection pump also including:

an electromechanical adjusting element connected to actuate the adjusting device;

a pulse generating means which is connected to generate a control pulse to the electromechanical adjusting element to alter the piston position;

a set-point transducer which generates set-point information to the adjusting device;

an adjustment-path transducer which generates adjustment path information to the adjusting device;

an electrical control device connected to generate a signal to the electromechanical adjusting element such that the electromechanical adjusting element is dependent on the electrical control device, and wherein the electrical control device is connected to the set-point transducer to receive the set-point information and to the adjustment path transducer to receive the adjustment path information, and wherein the electrical control device is also connected to generate a metering pulse to the magnetic inlet valve to determine duration of the magnetic valve opening.

12. An apparatus as defined in claim 11, wherein the injection pump includes a pump cylinder in which the piston is axially and rotationally guided, and wherein the apparatus includes:

the inlet line, having an inlet opening, connecting the pump work chamber to the fuel supply;

a first control edge on the piston, which operates to close the inlet opening during a supply stroke and having a second oblique control edge which acts as an axial limitation for the control face and is positioned such that the diversion opening is opened at the end of the supply stroke to release a return flow fuel quantity, and is closed after a predetermined portion of the intake stroke which permits re-aspiration of the return flow fuel quantity, wherein the magnetic inlet valve is a multi-way valve which in open position connects the inlet line to the pump work chamber with a constant inlet cross section, and in a closed portion blocks the pump work chamber from the inlet line, and wherein opening duration of the magnetic valve determines the quantity of fuel to be injected into the engine.

13. An apparatus as defined in claim 12, wherein the adjusting device has a regulating rod which engages the electromechanical adjusting element, wherein the piston is arranged such that a variable rotary position of the piston determines the return-flow fuel quantity, and controls supply onset and wherein the adjustment path transducer is connected to the piston to detect piston rotary position.

14. An apparatus as defined in claim 12, further including a line section which connects the magnetic inlet valve to the inlet opening, and wherein the inlet opening is embodied as a throttle bore having a cross section less than the magnetic inlet valve cross section and less than the line section cross section.

15. An apparatus as defined in claim 13, further including a line section which connects the magnetic inlet valve to the inlet opening, and wherein the inlet opening is embodied as a throttle bore having a cross section less than the magnetic inlet valve cross section and less than the line section cross section.

16. An apparatus as defined in claim 12, also including a constant pressure chamber wherein the piston has a jacket face, a portion of which closes the inlet opening from the pump work chamber during the supply stroke, and wherein the piston is provided with a relief channel arrangement which connects the inlet opening to the constant pressure chamber.

17. An apparatus as defined in claim 16, wherein the pressure of the constant pressure chamber is equal to the inlet pressure.

18. An apparatus as defined in claim 11, wherein the apparatus also includes:

an oblique control edge on the piston which acts as an axial limitation to the control face and which opens the diversion opening at the end of the supply stroke, a further valve which acts to close the diversion opening to prevent re-aspiration of a return-flow fuel quantity into the pump work chamber which is released at the end of the supply stroke; and wherein the magnetic valve is embodied as a multi-way valve which has an opening duration that determines a quantity of fuel to be injected into the engine and a quantity of fuel to replace the return-flow fuel quantity.

19. An apparatus as defined in claim 11, the pressure regulating valve having:

a pressure regulating spring;

an adjustment element which is connected to and corrected by the pressure regulating spring, wherein the apparatus includes a temperature sensing means which detects injection pump temperature and which is connected to the pressure regulating valve such that correction of the adjustment element by the pressure regulating spring is in accordance with injection pump temperature.

20. An apparatus as defined in claim 11, the pressure regulating valve having:

a pressure regulating spring;

an adjustment element which is connected to and corrected by the pressure regulating spring, wherein the apparatus includes a temperature sensing means which detects fuel temperature and which is connected to the pressure regulating valve such that correction of the adjustment element by the pressure regulating spring is in accordance with fuel temperature.

21. An apparatus as defined in claim 11, the pressure regulating valve having a chamber which contains a pressure regulating spring, the apparatus including:

an auxiliary pump having a work chamber, which is driven parallel to the injection pump, and is supplied with fuel from the fuel supply;

an intake line which connects the chamber of the pressure regulating valve with the auxiliary pump work chamber; wherein the intake line includes a check valve, which opens toward the work chamber, and wherein the auxiliary pump generates an underpressure which is substantially equal to a fuel vapor pressure occuring at an intake stroke of the injection pump and can be variably set to allow a partial filling of the auxiliary pump work chamber.

22. An apparatus as defined in claim 21, wherein the auxiliary pump is embodied as a piston pump.

23. An apparatus as defined in claim 11, the apparatus including:

a means to generate a metering pulse to the magnetic inlet valve;

a differentiation element which corrects the metering pulse to the magnetic inlet valve upon detecting a rapid shift in the instant of supply onset such that when the instant of supply onset shifts to a later time the fuel quantity is reduced, and such that when the instant of supply onset is towards an earlier time the fuel quantity is increased.

24. An apparatus as defined in claim 23, wherein the differentiation element generates a correction signal and is connected to the adjustment-path transducer, and wherein the electrical control device is connected to receive the correction signal from the differentiation element and an output from the adjustment-path transducer, which determine the correction of the metering pulse to the magnetic inlet valve in accordance with the correction signal and the adjustment-path transducer output.

25. An apparatus as defined in claim 23, also including an rpm transducer, which is connected to generate an output to the electrical control device, wherein the differentiation element is connected to generate a correction signal to the electrical control device to determine the correction of the metering pulse to the magnetic inlet valve in accordance with the correction signal and the rpm transducer output.

26. An apparatus as defined in claim 24, wherein the differentiation element is an electrical element and comprises an R-C circuit having at least one capacitor and two resistors.

27. An apparatus as defined in claim 25, wherein the differentiation element is an electrical element and comprises an R-C circuit having at least one capacitor and two resistors.

28. An apparatus as defined in claim 24, wherein the differentiation element is an electromechanical element which includes: an adjustment means, a potentiometer which is adjusted by the adjustment means; and at least one mechanical damping element connected to damp the movement of the potentiometer.

29. An apparatus as defined in claim 25, wherein the differentiation element is an electromechanical element which includes: an adjustment means; a potentiometer which is adjusted by the adjustment means; and at least one mechanical damping element connected to damp the movement of the potentiometer.

* * * * *